United States Patent [19]

Brown et al.

[11] Patent Number: 5,059,081

[45] Date of Patent: Oct. 22, 1991

[54] REFUSE TRUCK CONTAINER HANDLING APPARATUS

[75] Inventors: Christopher D. Brown, Pusheta Township, Auglaize County; Laverne F. Bown, Botkins, both of Ohio

[73] Assignee: Brown Welding Shop Inc., Botkins, Ohio

[21] Appl. No.: 434,132

[22] Filed: Nov. 9, 1989

[51] Int. Cl.[5] ..... B65F 3/02

[52] U.S. Cl. ..... 414/408; 414/421; 414/555; 414/486

[58] Field of Search ..... 414/406, 407, 408, 409, 414/419, 420, 421, 486, 487, 501, 546, 547, 555, 738

[56] References Cited

U.S. PATENT DOCUMENTS

| | | | |
|---|---|---|---|
| 2,949,199 | 8/1960 | Jones | 414/408 |
| 3,140,787 | 7/1964 | Clar | 414/408 |
| 3,837,512 | 9/1974 | Brown . | |
| 3,857,503 | 12/1974 | Brown . | |
| 4,091,944 | 5/1978 | Gollnick | 414/408 X |

OTHER PUBLICATIONS

Brochure Titled "The WaBo Unit" Published by Brown Welding Shop, Inc. About 1980-1981.

*Primary Examiner*—Frank E. Werner

*Attorney, Agent, or Firm*—Roger S. Dybvig

[57] ABSTRACT

Apparatus for attachment to a refuse truck for moving a refuse container platform from a ground loading station to elevated, inverted dumping and/or washing stations above the truck bed includes a pair of elevating assemblies connected to the sides of the truck body and to the container platform that act substantially in unison to move the container platform relative to the truck bed. Each elevating assembly includes an arm assembly connected to the container platform and pivoted by a hydraulic cylinder. Each arm assembly has first and second arms pivotally connected to one another. In operation, the second arm is pivoted relative to the first arm into a vertical position to move the container platform from ground level to a position above the truck bed, then both arms pivot together to move the container platform horizontally forwardly over the truck bed but not substantially higher off the ground. As the latter movement continues, the second arm begins to reversely pivot relative to the first arm so that the arm assembly straightens as it approaches the forward end of the top of the truck bed.

15 Claims, 5 Drawing Sheets

REFUSE TRUCK CONTAINER HANDLING APPARATUS

SUMMARY OF THE INVENTION

This invention relates to a refuse truck container handling apparatus. Although not necessarily so limited, this invention more particularly relates to container handling apparatus for trucks for collecting and transporting animal renderings such as meat scraps, animal skins, and raw blood. More generally, the invention may be used in other circumstances wherein there is a need for lifting a container or other load to a fairly substantial height and for moving the load through a fairly substantial horizontal distance.

Refuse truck container handling apparatus is used to move a platform or loader for large refuse containers from a position at ground level behind the truck to a dumping compartment above and forwardly of the rear of the truck into which the refuse in the containers is dumped by elevating them above the truck and inverting them above the dumping compartment. The truck may have an elongate dumping compartment extending generally from the rear to the forward end of the truck bed immediately behind the truck cab. Optionally, there may be a compartment separate from the loading compartment located immediately behind the truck cab for automatic washing equipment by which the refuse containers are sprayed and thoroughly washed while they are held in inverted position. Following either the complete dumping or the washing of the containers, they are returned to the rear loading station or the rear transporting station.

A prior mechanism, known as an "arm" mechanism, has proved to be a successful, economical, and efficient mechanism for handling the container platforms. The prior arm mechanism includes a pair of elongate main lifting arms located on opposite sides of the truck body having corresponding ends welded to a cross shaft mounted for rotation on the the truck bed. The rear ends of the lifting arms are pivotally connected to the container platform and hydraulic dumping cylinders are mounted between the lifting arms and the platform to control the orientation of the platform. Utilizing an invention disclosed in U.S. Pat. No. 3,837,512, granted to Donald C. Brown on Sep. 24, 1974, the prior arm mechanism includes a pair of hydraulic cylinders, one on each side of the truck, pivotally secured by a rigid bracket to the truck bed have piston rods each pivotally connected to one end of a relatively short rigid connector link. The other end of the connector link is connected to parts rigidly connected to the main lifting arm. A pair of fixed rails are rigidly connected to the truck bed between the hydraulic cylinder and the fixed main pivot. As a result of this construction, the pivot pins at the outer ends of the piston rods travel in an arcuate path during initial retraction of the piston rods but then travel in a straight line path when they engage the fixed rails. Because of this construction, a relatively short movement of the rigid links powered by the hydraulic cylinders produces a relatively great arc of movement of the main lifting arms. The necessary extent of movement of the main lifting arms is obtained without employing power cylinders having excessive and impractical piston stroke lengths and pivot spacings. The sliding engagement between the rigid links and the fixed rails eliminates any tendency for the mechanism to bind and results in a smooth operation.

Although the prior arm mechanism is successfully used and considered to be superior to other refuse container dumping devices, such mechanism is only fully satisfactory for truck beds having a length of approximately twenty feet or less. As the length of the truck bed increases, the main lifting arms necessarily must increase in length in order to fully accomodate the longer length of the truck bed. As a result, the containers must be lifted higher, thereby undesirably increasing the possibility for the material carried by the containers to be blown off to the side of the truck when dumped. There is also an increased likelihood for contact with overhead objects such as tree limbs or wires. A higher lift may also lead to a requirement for an increase in the strength of components of the mechanism in order to assure that the containers will be safely elevated. Therefore, a need exists for apparatus which has the advantages of the prior arm mechanism of simplicity, efficiency, and smooth operation and which is satisfactory for truck beds exceeding twenty feet in length and may also be used on shorter truck beds, and it is the primary object of this invention to provide such apparatus.

In accordance with this invention, improved apparatus for attachment to a refuse truck is provided for moving a refuse container platform from a ground loading station to elevated, inverted dumping and/or washing positions above the truck bed. The apparatus includes a pair of elevating means connected to the sides of the truck body and to the container platform that act substantially in unison to move the container platform relative to the truck bed. Each of the elevating means includes an arm assembly comprising first and second arms pivotally connected to one another. The first arm is connected to a cross shaft extending across the truck bed and the second arm is pivotally connected to the container platform. A hydraulic drive cylinder is connected by a first drive link to the first arm and by a second drive link to the second arm. When the piston rod of the cylinder is extended, the first arm is supported by the cross shaft and a support member affixed to the truck bed in spaced relation to the cross shaft and the second arm is in approximate alignment with the first arm and extends to the platform on the ground. Upon initial retraction of the piston rod, the second arm is pivoted relative to the first arm into a vertical position to move the container platform from ground level to a position above the truck bed. Continued retraction of the piston rod causes both of the arms to pivot together about the axis of the cross shaft as a result of which the container platform is moved horizontally forward over the truck bed but not substantially higher off the ground. During a portion of the latter movement, the ends of the piston rod and the links connected thereto are supported by a guide rail construction. As the latter movement continues, the second arm begins to reversely rotate relative to the first arm so that the arm assembly begins to straighten out and is almost completely straight when it reaches the forward end of the top of the truck bed. The container platform is returned to ground level by subsequent extension of the piston rod. A dumping cylinder arrangement may be used to control the orientation of the container platform relative to vertical.

Other objects and advantages will become apparent from the following description and the drawings.

DETAILED DESCRIPTION

Figure 1:
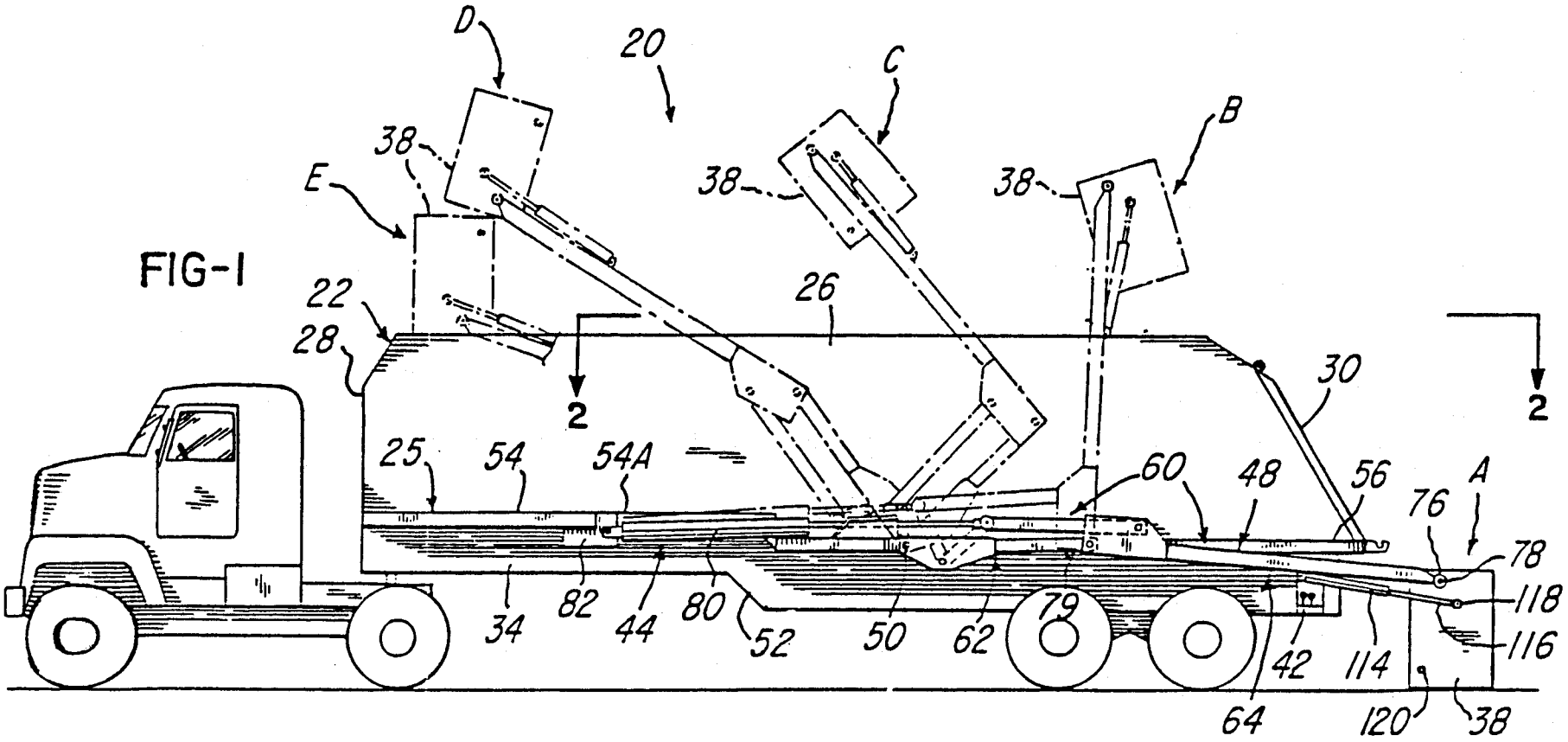
FIG. 1 is a simplified side elevational view of a refuse truck provided with a refuse container handling apparatus in accordance with this invention and shows, by phantom lines, different positions of the container platform and the container handling apparatus.
Figure 2:
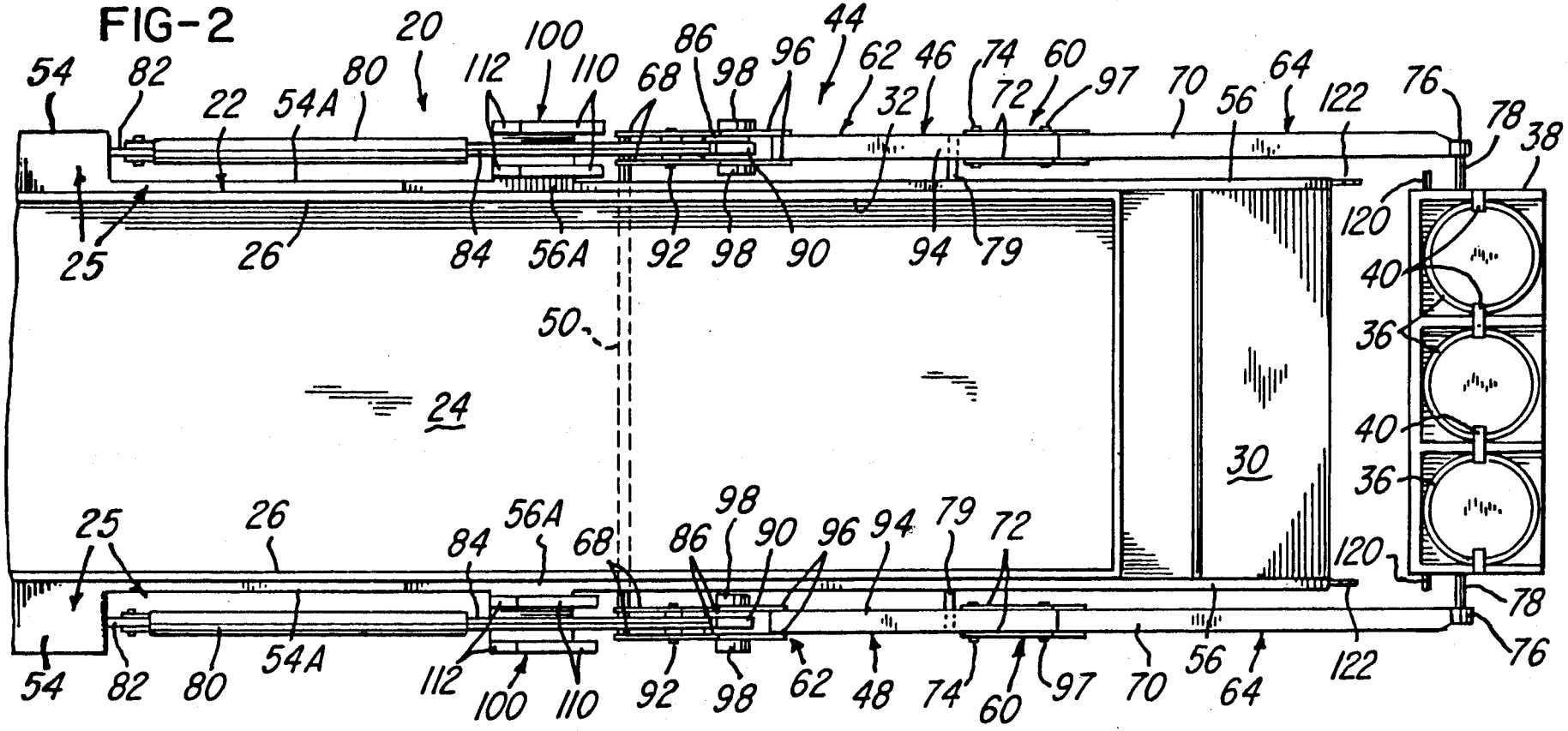
FIG. 2 is a simplified, enlarged, fragmentary plan view of a portion of the truck and apparatus of FIG. 1 encompassed by the view lines 2—2 thereof.

A refuse truck, generally designated 20, of the type used in the rendering industry to collect and transport meat scraps, skins, and the like is illustrated in FIGS. 1 and 2. Such a truck has a fluid-tight bed 22 having a floor 24, a pair of sidewalls 26, and a front wall 28. The bed 22 further has a tailgate 30 and a top opening 32 through which the refuse may be dumped. Plural cross members (not shown) support the floor 24 on a main frame 34 and a rub rail 25 connected to the ends of the cross members extends along both sides of the truck bed 22. Mechanism (not shown) is provided for pivotally mounting the truck bed 22 on the truck frame 34 and for elevating the front end of the truck bed 22 to dump its contents. The tailgate 30 is hinged to the rear of the truck bed sidewalls 26 as will readily be understood by those familiar with the art. Optionally, as described in said Brown '512 patent, the extreme forward end of the truck bed 22 may be provided with a washing compartment (not shown) for spray washing equipment.

As illustrated in FIG. 2, plural refuse containers 36 are loaded side-by-side on a container platform 38. Platform and safety container locking means, including fixed stops 40, are provided that secure the containers 36 on the platform 38 for movement therewith. Container retaining means (not shown) of the type described in U.S. Pat. No. 3,857,503, granted to Donald C. Brown on Dec. 31, 1974, are preferably also provided. In any event, the containers 36 are so affixed to the platform 38 that their orientation relative to vertical is the same as the orientation of the platform 38. The platform 38, as shown in full lines in FIG. 1, is vertically upright when it is resting on the ground in a container-loading station, designated A, behind the rear of the truck bed 22.

The apparatus of this invention enables a single operator using simple hydraulic valve controls 42 (FIG. 1) to first elevate the platform 38 to a station B above the rear of the truck bed 22, then move it arcuately forwardly along the length of the truck bed 22, at little added height above ground, through a continuum of intermediate positions, as represented by stations C and D in FIG. 1, and, if desired, all the way to a station E at the extreme forward end of the top opening 32. At any of the stations B, C, D, or E, the container platform 38 and the refuse containers 36 secured thereto may be inverted in order to dump their contents into the truck bed 22 by a dumping cylinder described below.

In accordance with this invention, a platform elevating and dumping assembly, generally designated 44, is provided for lifting the container platform 38 from station A upwardly around the back and over the top of the truck bed 22 selectively to stations B, C, D, or E. The platform elevating and dumping assembly 44 comprises two container-elevating means or subassemblies 46 and 48, one on each side of the truck body, and a cross shaft 50 interconnecting the two subassemblies 46 and 48, as will be described below. The subassemblies 46 and 48 are preferably mutually identical except for such variations that may be necessary or desirable to adopt them for connection to opposite sides of the truck bed 22 and the container platform 38. Accordingly, only the container-elevating subassembly 48 shown in FIG. 1 is illustrated in FIGS. 3 through 10, it being understood that the container-elevating subassembly 46 will operate in the same manner and be constructed the same or essentially the same as the container-elevating subassembly 48 and will operate substantially in unison therewith. In FIG. 2, like parts of the two container-elevating subassemblies 46 and 48 are given the same reference numbers.

The cross shaft 50 mentioned above is mounted for rotation about its longitudinal axis (which is perpendicular to the longitudinal axis of the truck 20) by bearings (not shown) mounted between a pair of the aforementioned cross members. Each end of the cross shaft 50 extends outwardly through the rub rails 25 past the sides of the truck bed 22, as may be understood from a comparison of FIGS. 2 and 3.

As may be seen from a comparison of FIGS. 1, 2, 3, and 8, the main frame 34 has a "step down" portion 52 and each rub rail 25 has an upper, forward section 54, and a lower, rearward section 56. The rearward portion, designated 54A, of each forward rub rail section 54 is of lesser horizontal extent than its forwardmost portion in order to provide space along the sides of the truck bed 22 for parts of the subassemblies 46 and 48. Except for relatively short portions, designated 56A, the entirety of the rearward rub rail sections 56 have the same, relatively narrow extent as the rearward portion 54A of the forward rub rail section 54. The relatively short rub rail portions 56A extend further outwardly from the truck sidewalls 26 to provide support for parts of the subassemblies 46 and 48 as described below.

The container-elevating subassembly 48 comprises an arm assembly, generally designated 60, having a first, forward arm, generally designated 62, and a second, rearward arm, generally designated 64. (As used in this description and the claims that follow, the relative terms "forward" and "rearward" and "upper" and "lower", and terms of similar import, in reference to parts of the subassembly 48 are used relatively to the forward, rearward, upper, or lower parts of the truck 20, as the case may be, when the parts of the subassembly 48 are in the positions they occupy when the container platform 38 is resting on the ground. This is the position shown in full lines in FIG. 1 and in FIGS. 2, 3, and 8.

First arm 62 includes a straight, rigid rod 66 and a pair of forwardly extending, mutually spaced and parallel, pivot connection plates 68, one on each side of the rod 66 and rigidly connected thereto. To provide for pivotal movement of the first arm 62 about the axis of the cross shaft 50, the forward end of both pivot connection plates 68 have bores which receive the end of the cross shaft 50 to which the pivot connection plates 68 are affixed as by welding.

Second arm 64 includes a straight, rigid rod 70 and a pair of forwardly extending, pivot connection plates 72, one on each side of the rod 70 and rigidly connected thereto. The forward end of the second arm 64 is mounted for pivotal movement in a vertical plane and relative to the first arm 62 by a pivot pin 74 extending through the rearward end of the first arm 62 and the forward end of the second arm 64. The rearward end of the second arm 64 is provided with an eyelet 76 (FIG. 8) for rotatably receiving a container-platform mounting pin 78 (FIGS. 1 and 2) extending from the side of the container platform 38.

Figure 3:
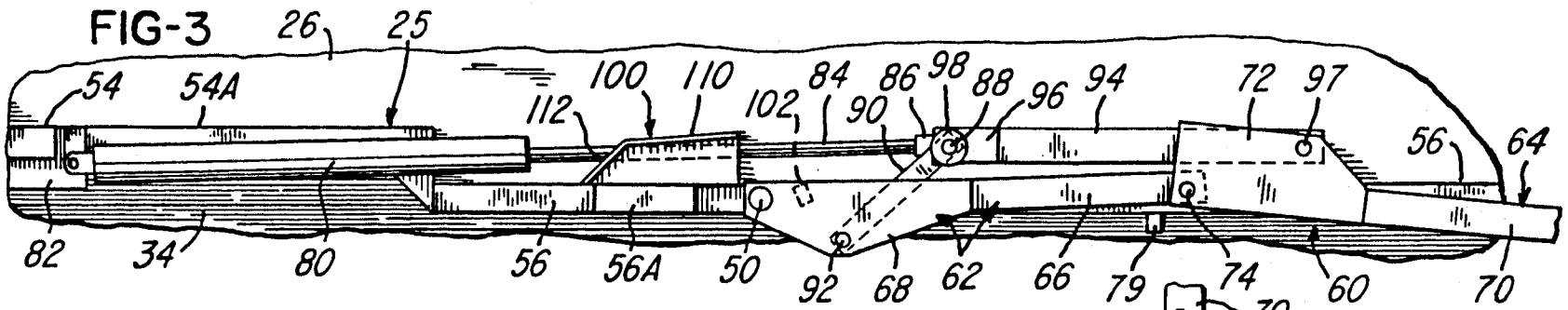
FIG. 3 is an enlarged, fragmentary side elevational view of the body of the truck and the refuse container handling apparatus of FIG. 1.
Figures 8, 9, 10:
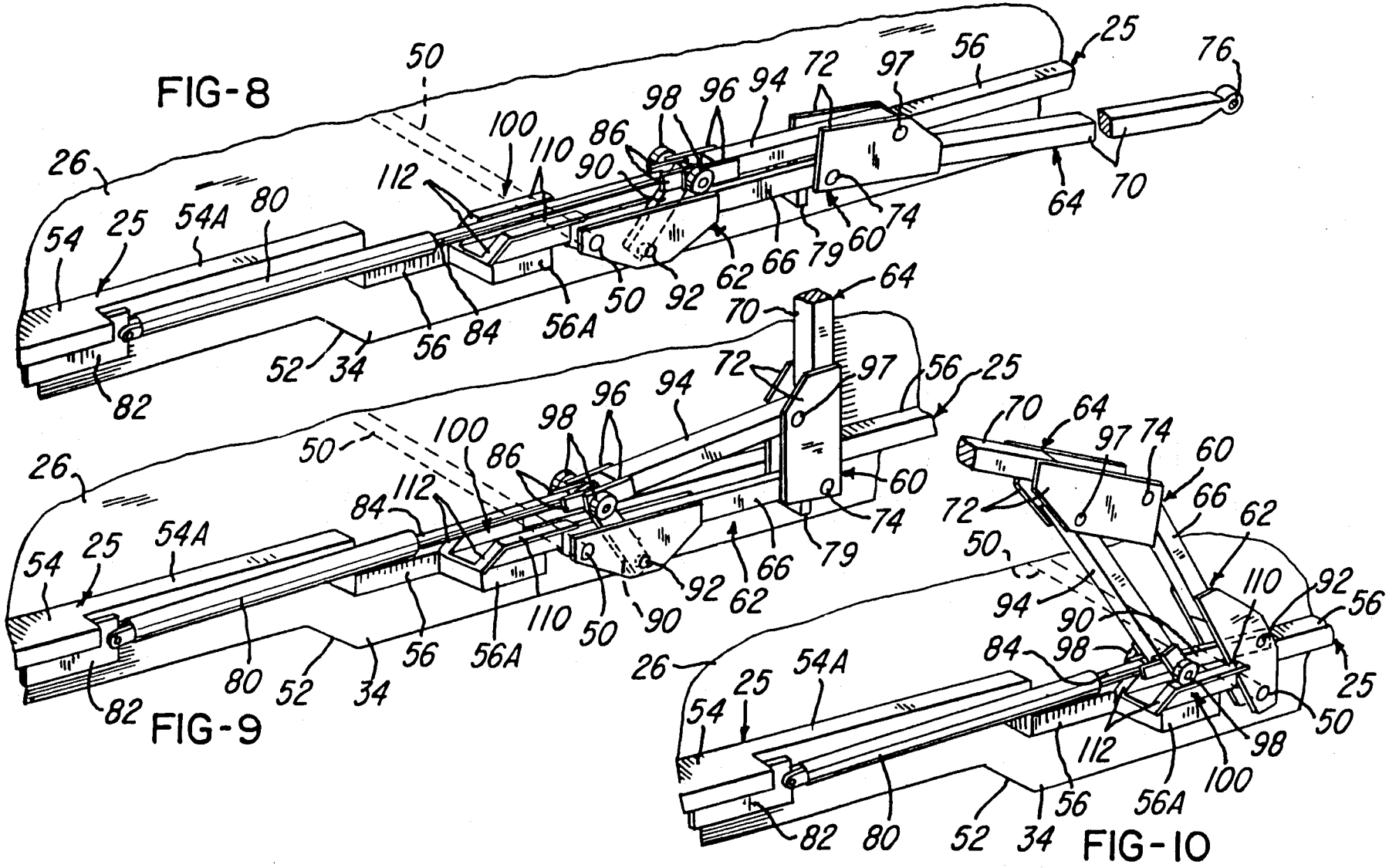
FIG. 8 is a fragmentary perspective view of a portion of the container handling apparatus of FIG. 1 with the parts thereof shown in positions corresponding to the positions thereof illustrated in side elevational view in FIG. 3.
FIG. 9 is a fragmentary perspective view of a portion of the container handling apparatus of FIG. 1 with the parts thereof shown in positions corresponding to the positions thereof illustrated in side elevational view in FIG. 4.
FIG. 10 is a fragmentary perspective view of a portion of the container handling apparatus of FIG. 1 with the parts thereof shown in positions corresponding to the positions thereof illustrated in side elevational view in FIG. 6.

With reference to FIGS. 1, 3, and 8, when the container platform 38 is resting on the ground, the first arm 62 lies with its longitudinal axis extending substantially horizontally and is supported in this position by the truck bed 22. Thus, first arm 62 is supported in the substantially horizontal position at its forward end by the cross shaft 50 and at its rearward end by a support member 79 welded or otherwise affixed to the cross members that support the rub rail 25. At this time, the second arm 64 slopes slightly downwardly from front to rear. The container platform 38 may be elevated from the ground level to position B above the rear of the truck bed 22 by pivotal movement of the second arm 64 about the rearward end of the first arm 62. Thereafter, the container platform 38 is moved forwardly in a slightly arcuate path by pivotal movement of both the first arm 62 and the second arm 64 about the axis of the cross shaft 50. These movements are accomplished by operation of a hydraulic main drive cylinder 80 pivotally mounted at its forward end, which is forward of the cross shaft 50, to a bracket plate 82 welded or otherwise rigidly affixed to the truck bed 22. Cylinder 80 is used to extend and retract its piston rod 84 which has a pair of axle support plates 86 at its rear most end which rotatably support an axle 88 for rotation about a horizontal axis extending therethrough.

A first, forward, relatively short, drive link 90 is mounted between the axle support plates 86 for rotation on the axle 88 and extends between the pivot connection plates 68 of the first arm 62 to a pivot 92 thereon that is located intermediate the ends of the pivot connection plates 68 at a point below and rearwardly of the cross shaft 50. A second, relatively long, drive link 94 has a pair of forwardly extending connecting plates 96 that straddle the axle support plates 86 projecting rearwardly from the piston rod 84 and that are also rotatably connected to the axle 88. The rearward end of the second drive link 94 is connected by a pivot 97 to the second arm 64.

A pair of bearings or support rollers 98 mounted on the opposite ends of the axle 88 roll along the top surfaces of a pair of guide rails 100 during part of the pivotal or swinging movement of the arm assembly 60 as will be described below.

Figure 4:
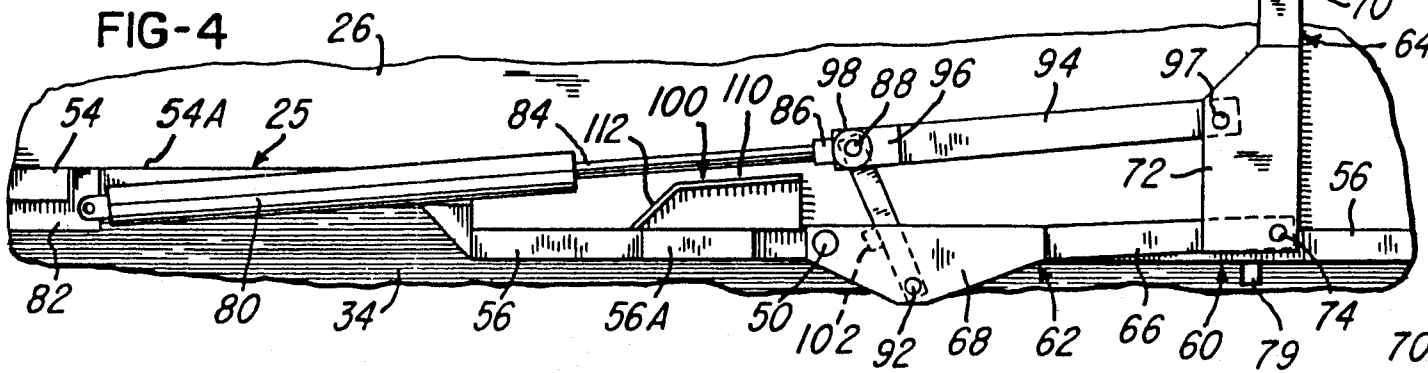
FIGS. 4, 5, 6, and 7 are fragmentary side elevational views to FIG. 3 but with the container handling apparatus shown in successive operating stages thereof when elevating the container platform.

FIGS. 3 through 7 illustrate the progressive movements of the arm assembly 60 to elevate the container platform 38 from ground level station A to the extreme forward station E. As previously noted, FIG. 3 shows the position of the parts of the arm assembly 60 when the container platform is at ground level station A. This same position is illustrated in FIGS. 1, 2, and 8. In this position, the pivot 97 between the second drive link 94 and the second arm 64 is located rearwardly and above the point of pivotal connection at 74 of the second arm 64 to the first arm 62. Also, the axle 88 is rearward and above the pivot point 92 of the first drive link 90 to the first arm 62. Upon initial retraction of the piston rod 84, which is in the forward direction, the piston rod 84 and the second drive link 94 cause the pivot point 97 on the second arm 64 to be pulled forwardly whereupon it causes the second arm 64 to pivot relative to the first arm 62 to an essentially vertical orientation as shown in FIG. 4 and FIG. 9, in a counterclockwise direction as viewed in the drawings. At the same time, the first drive link 90 rotates upwardly and forwardly around pivot 92 so that the first arm 62 remains stationarily supported by the cross shaft 50 and the support member 79 and the drive link 90 and, accordingly, provides leverage useful for pivoting the second arm 64 upwardly. Also, a substantial portion of the weight of the load being elevated is supported by the truck bed 22 through the first arm 62 supported thereby and the first drive link 90.

As a result of the pivotal movement of the second arm 64 relative to the first arm 62 as described above, the second arm 64 is moved to a position wherein it is approximately perpendicular to the first arm 62 and holds the container platform 38 at station B. Here, it can be observed that the length of the second arm 64 must be sufficiently greater than the height of the truck bed sidewalls 26 that the container platform 38 will clear the top of the sidewalls 26 as the container platform 38 is moved from station A to station B.

As the second arm 64 is pivoted to vertical, the first drive link 90 approaches a stop dog 102 extending between and affixed to the first arm pivot connection plates 68. When the first drive link 90 strikes the stop dog 102, further pivotal movement of the first drive link 90 forwardly or in a counterclockwise direction relative to the first arm 62 is prevented. Accordingly, upon initial continued retraction of the piston rod 84, the approximately perpendicular relationship between the first arm 62 and the second arm 64 is maintained and the entire arm assembly 60 begins to pivot about the axis of the cross shaft 50. Shortly after the entire arm assembly 60 begins to pivot in this fashion, the support rollers 98 engage the rearward ends of the guide rails 100 as shown in FIG. 5.

When the support rollers 98 roll along the top surfaces of the guide rails 100, the guide rails 100 support a substantial portion of the total weight of the arm assembly 60 and the container platform 38. As will be appreciated by a study of FIGS. 5 and 6, when the arm assembly 60 begins to move the container platform 38 from station B toward station C, the second arm 64, which now extends forwardly, forms a lever having a fulcrum about its point of connection to the second drive link 94 so that a substantial portion of the weight of the container platform 38 must be supported by the second drive link 94. This weight in turn is transferred to the guide rails 100 and then in turn to the relatively short rub rail section 56A upon which the guide rails 100 are mounted.

Figure 5:
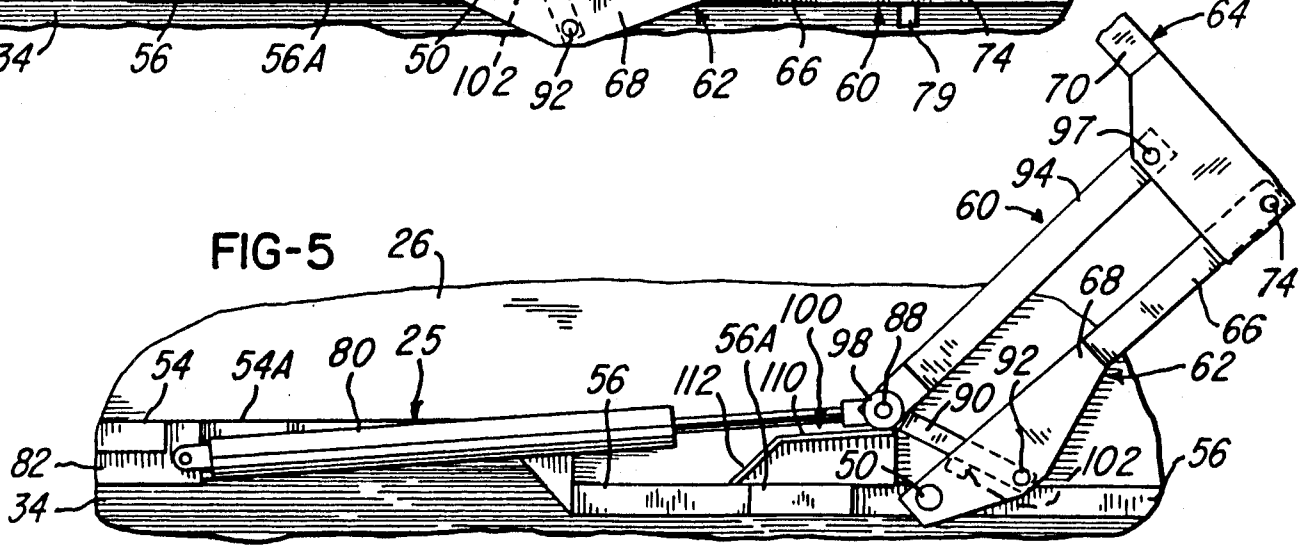
Figure 6:
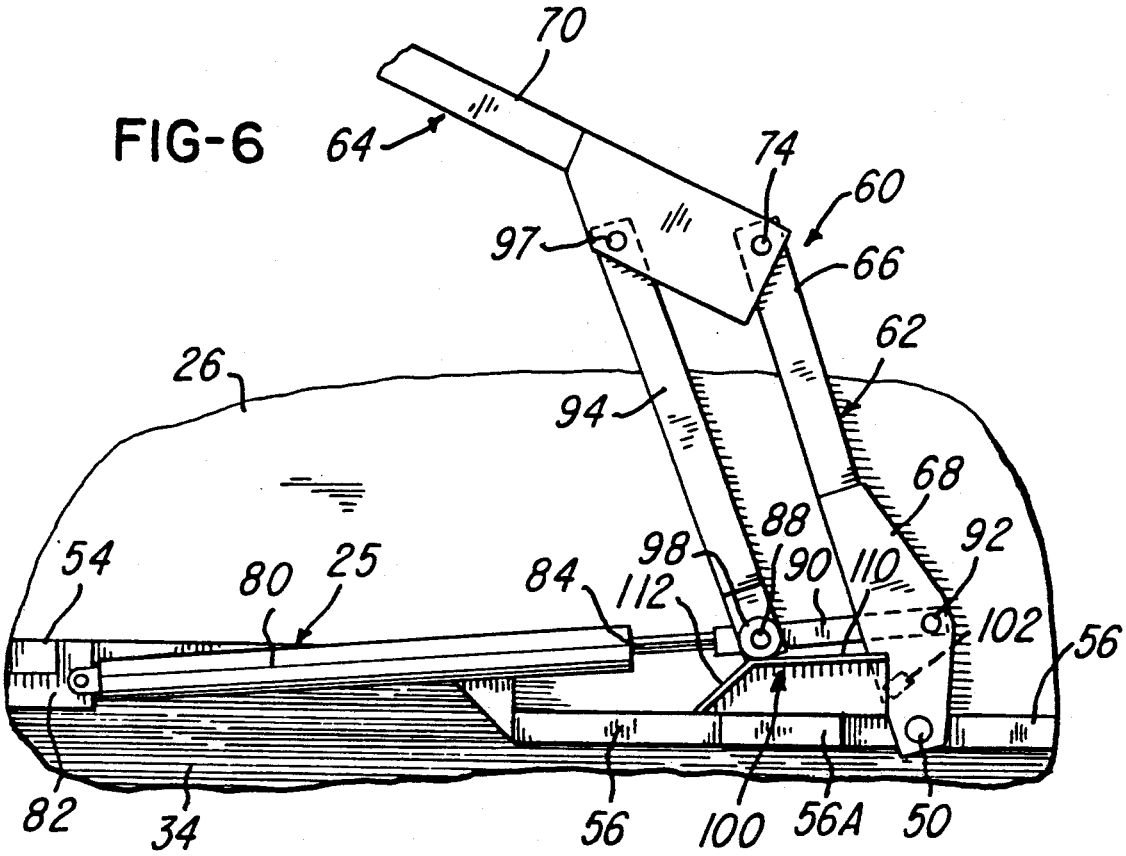
Figure 7:
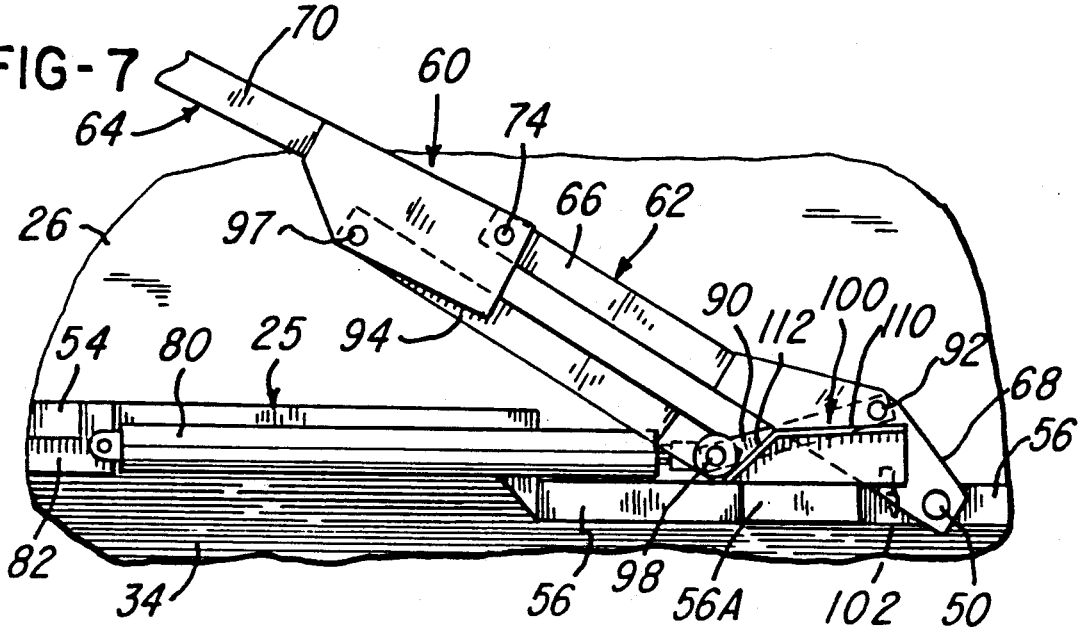

As the support rollers 98 move forwardly along the guide rails 100, the first drive link 90 moves away from the stop dog 102 and the arm assembly 60 begins to straighten out by a reverse rotation of the second arm 64 relative to the first arm 62 as can be seen from a comparison of FIG. 5 with FIG. 6 which represent, respectively, the approximate positions of parts when the container platform 38 is located in station C and station D. If the container platform 38 is to be brought all the way forwardly to station E, the parts of the arm assembly 60 will be relatively positioned as shown in FIG. 7, wherein the second arm 64 is nearly aligned with the first arm 62. The second arm 64 is preferably not reversely rotated relative to the first arm 62 to the point at which the two arms 60 and 62 are in a straight line to reach station E because the mechanism may bind up when subsequently attempting to return the container platform 38 from station E to station A.

When the container platform 38 reaches station E, the mounting pins 78 extending outwardly from its sides engage the upper surfaces of the truck bed sidewalls 26, which therefore support the container platform 38. At any position of the container platform 38 over the top opening 32 of the truck bed 22, the swinging motion of the arm assembly 60 may be interrupted and the container platform 38 inverted to dump the contents of the refuse containers 36 into the truck bed 22. As previously noted, station E may be located over a washing compartment in which event the containers 36 would be emptied before the container platform 38 is moved into station E so that it can be washed out.

The container platform 38 may be returned from any of the elevated stations B through E to the ground level station A. Such return is accomplished simply by extension of the piston rod 84 to the position thereof illustrated in FIGS. 1, 2, 3, and 8. During extension of the piston rod 84 to return the container platform 38 from station E to station A, the parts of the arm assembly 60 pass reversely through the various positions illustrated in FIGS. 4 through 7.

The guide rails 100 are spread apart sufficiently to permit the first arm 62 to enter therebetween as the container platform 38 is moved to its forward positions at stations D and E. This condition is shown best in FIGS. 6 and 7. Trial and error may be needed to determine the optimum contour of the guide rails 100. The guide rails 100 illustrated in each of FIGS. 3 through 9 have a first, rearward, top surface portion 110 that slopes slightly downwardly from rear to front and a second, forward portion 112 that slopes sharply downwardly from rear to front. The geometry is such that the more sharply sloped forward portion 112 results in a rather steep vertical movement of the container platform 38 as it moves into and out of station E. This provides the advantage, which may be especially important if spray washing equipment is used, that the container platform 38 will not slide along the top of the truck sidewalls 26 in the vicinity of station E.

Operation of the subassemblies 46 and 48 substantially in unison when the cross shaft 50 rotates with the arm assemblies 60, i.e., when the container platform 38 is being moved between station B and station E generally horizontally over the truck bed 22, results from the fact that both first arms 62 of the subassemblies 46 and 48 are connected by the cross shaft 50. For this purpose, the cross shaft 50 is preferably quite rigid and strong. A cross shaft 50 made from three inch diameter steel rod has been found satisfactory for use with a truck bed that is twenty-seven feet long. Because the cross shaft 50 is idle when the container platform 38 moves between stations A and B, it cannot control the timing of the operation of the main drive cylindes 80 and, therefore, cannot then provide a timing function. Accordingly, in order to provide substantial unison operation of the subassemblies 46 and 48 when the container platform 38 is being elevated from station A to station B, the hydraulic circuit that controls the operation of the main drive cylinders 80 preferably includes a commercially available proportional flow divider (not shown).

When the subassemblies 46 and 48 are operating to raise and lower the container platform 38 and move it horizontally along the truck bed 22, the orientation of the container platform 38 may be controlled by a dumping cylinder 114 having a piston rod 116 pivotally connected at 118 to the side of the container platform 38. The hydraulic circuit and the controls 42 for operating the hydraulic cylinders 80 and 114 may use entirely conventional components operating in a conventional fashion. For this reason the circuit and controls are not described or illustrated herein.

Because the second arm 64 is pivoted to an approximate perpendicular position with respect to the first arm 62 when the first arm 62 begins to pivot about the axis of the cross shaft 50, at which time the container platform 38 is moving horizontally toward the front of the truck bed 22, the elevated height of the container platform 38 is substantially lower than it would be if the arm assembly 60 were a simple, one-piece arm. The fact that the arm assembly 60 begins to straighten out as the container platform 38 is moved forwardly along the truck bed 22 enables the forward reach of the arm assembly 60 to be maximized while still carrying the load platform at a relatively low height above the truck bed 22.

In addition to moving the container platform 38 to and between stations A through E for dumping the contents of the containers 36 into the truck bed 22, provision must be made for connecting the container platform 38 to the truck bed 22 during transport. For this purpose, the container platform 38 is provided with laterally extending pins 120 that engage hooks 122 mounted on the rear ends of the rub rails 25. As is believed apparent, the the container platform 38 may be raised to a level wherein the extension pins 120 are in approximate horizontal alignment with the hooks 122 and the extension pins 120 lodged in the hooks 122 by appropriate manipulation of the hydraulic cylinders 80 and 114.

Although the presently preferred embodiment of this invention has been described, it will be understood that within the purview of this invention various changes may be made within the scope of the appended claims.

Having thus described our invention we claim:

1. Container platform elevating and dumping apparatus for attachment to a refuse truck having a truck bed for receiving refuse, said apparatus moving a refuse container platform from a container loading station substantially at ground level to at least one elevated and inverted station above said truck bed, said apparatus being adapted to lift said container platform from said container loading station upwardly around one end of said truck bed and over the top of said truck bed toward the opposite end of said truck bed, and said apparatus comprising:

cooperating first elevating means connected to one side of said truck bed and to one side of said container platform and second elevating means connected to the other side of said truck bed and to the other side of said container platform for moving said container platform both vertically above said truck bed and, when elevated, generally horizontally along the top of said truck bed;

each of said elevating means comprising:

a vertically swingable arm assembly comprising a first arm having a first end mounted on said truck bed for pivotal movement about a horizontal axis extending transversely of said truck bed and a second end remote from said first end, and a second arm having a first end pivotally connected to said second end of said first arm and a second end connected to said container platform; and drive means connected to said first arm and to said second arm for pivoting said second arm relative to said first arm in a first relative rotary direction to elevate said container platform and for thereafter pivoting said first arm together with said second arm about said horizontal axis while pivoting said second arm relative to said first arm in a second relative rotary direction reversed to said first relative rotary direction to move said container platform in a substantially horizontal path over the top of said truck bed.

2. The apparatus of claim 1 wherein said drive means of each of said arm assemblies includes a first link having a first end pivotally connected to said first arm and a second end, a second link having a first end pivotally connected to said second arm and a second end pivotally connected to said second end of said first link, and motive means connected to said second end of each of said links that, when actuated to elevate said container platform, pulls said second link toward said opposite end of said truck bed and pivots said first link relative to said first arm in the same relative direction as said second arm is pivoted about said first arm in said first relative rotary direction, and said drive means further comprises a stop on said first arm in the path of the pivotal movement of said first link that, when engaged by said first link, prevents continued pivotal movement of both said first link relative to said first arm and the pivotal movement of said second arm relative to said first arm in said first relative rotary direction so that further operation of said motive means tending to pull said second arm towards said opposite end of said truck bed causes said first arm to pivot about said horizontal axis.

3. The apparatus of claim 2 wherein said motive means of each of said elevating means comprises a hydraulic actuator.

4. The apparatus of claim 3 wherein said hydraulic actuator of each of said elevating means has a piston rod having a free end pivotally connected to said second ends of both of its associated said first link and said second link.

5. The apparatus of claim 3 wherein each of said hydraulic actuators comprises a cylinder and cylinder mounting means are provided for connecting said cylinders to said truck bed for pivotal movement of said cylinders about an axis parallel to said horizontal axis.

6. The apparatus of claim 5 further comprising a pair of support members on said truck bed, one on each side thereof, each located on said truck bed at a position spaced from said horizontal axis in the direction of said one end, said support members and said means for pivotally mounting said first arms on said truck bed cooperating to support said first arms when not elevated.

7. The apparatus of claim 4 further comprising bearings mounted on said free end of said piston rods, and wherein a pair of guide rails are mounted, respectively, on both sides of said truck bed along the paths of movement of said free end of said piston rod while said container platform is moved substantially horizontally over said truck bed, and wherein said bearings ride on said guide rails and said bearings, and thereby said arms and said links, device support from said guide rails.

8. The apparatus of claim 1 wherein said guide rails slope downwardly gradually in the direction of said one end to said opposite end of said truck bed over a substantial portion of their length and slope sharply downwardly at their ends nearest said opposite end so that said container platform is moved along a relatively steeply sloping path as it approaches said opposite end of said truck bed.

9. Container platform elevating and dumping apparatus for attachment to a refuse truck having a truck bed for receiving refuse, said apparatus moving a refuse container platform from a container loading station substantially at ground level to at least one elevated and inverted station above said truck bed, said apparatus being adopted to lift said container platform from said container loading station upwardly around one end of said truck bed and over the top of said truck bed toward the opposite end of said truck bed, and said apparatus comprising:

cooperating first elevating means connected to one side of said truck bed and to one side of said container platform and second elevating means connected to the other side of said truck bed and to the other side of said container platform for moving said container platform both vertically above said truck bed and, when elevated, along the top of said truck bed;

each of said elevating means comprising:

a vertically swingable arm assembly comprising a first arm having a first end mounted on said truck bed for pivotal movement about a horizontal axis extending transversely of said truck bed and a second end remote from said first end, and a second arm having a first end pivotally connected to said second end of said first arm and a second end connected to said container platform; and drive means connected to said first arm and to said second arm for pivoting said second arm relative to said first arm in a first relative rotary direction to elevate said container platform and for thereafter pivoting said first arm together with said second arm about said horizontal axis to move said container platform over the top of said truck bed, said drive means including a first link having a first end pivotally connected to said first arm and a second end, a second link having a first end pivotally connected to said second arm and a second end pivotally connected to said second end of said first link, and motive means connected to said second end of each of said links that, when actuated to elevate said container platform, pulls said second link toward said opposite end of said truck bed and pivots said first link relative to said first arm in the same relative direction as said second arm is pivoted about said first arm in said first relative rotary direction, and said rive means further comprises a stop on said first arm in the path of the pivotal movement of said first link that, when engaged by said first link, prevents continued pivotal movement of both said first link relative to said first arm and the pivotal movement of said second arm relative to said first arm in said first relative rotary direction so that further operation of said motive means tending to pull said second arm toward said opposite end of said truck bed causes said first arm to pivot about said horizontal axis.

10. The apparatus of claim 9 wherein said motive means of each of said elevating means comprises a hydraulic actuator.

11. The apparatus of claim 10 wherein said hydraulic actuator of each of said elevating means has a piston rod having a free end pivotally connected to said second ends of both of its associated said first link and said second link.

12. The apparatus of claim 11 further comprising bearings mounted on said free end of said piston rods, and wherein a pair of guide rails are mounted, respectively, on both sides of said truck bed along the paths of movement of said free end of said piston rod while said container platform is moved substantially horizontally over said truck bed, and wherein said bearings ride on said guide rails and said bearings, and thereby said arms and said links, derive support from said guide rails.

13. The apparatus of claim 12 wherein said guide rails slope downwardly gradually in the direction of said one end to said opposite end of said truck bed over a substantial portion of their length and slope sharply downwardly at their ends nearest said opposite end so that said container platform is moved along a relatively steeply sloping path as it approaches said opposite end of said truck bed.

14. The apparatus of claim 10 wherein each of said hydraulic actuators comprises a cylinder and cylinder mounting means are provided for connecting said cylinders to said truck bed for pivotal movement of said cylinders about an axis parallel to said horizontal axis.

15. The apparatus of claim 14 further comprising a pair of support members on said truck bed, one on each side thereof, each located on said truck bed at a position spaced from said horizontal axis in the direction of said one end, said support members and said means for pivotally mounting said first arms on said truck bed cooperating to support said first arms when not elevated.

* * * * *

UNITED STATES PATENT AND TRADEMARK OFFICE

CERTIFICATE OF CORRECTION

PATENT NO. : 5,059,081

DATED : October 22, 1991

INVENTOR(S) : Christopher D. Brown & Laverne F. Brown

It is certified that error appears in the above-indentified patent and that said Letters Patent is hereby corrected as shown below:

Column 3, line 15, --similar-- should be inserted after "views".

Column 9, line 49, in Claim 2, "towards" should read --toward--.

Column 10, line 11, in Claim 7, "device" should read --derive--.

Column 10, line 12, in Claim 8, the claim reference numeral 1 should read --7--.

Column 11, line 1, in Claim 9, "rive" should read --drive--.

Signed and Sealed this

Sixth Day of August, 1996

*Attest:*

Bruce Lehman

BRUCE LEHMAN

*Attesting Officer*

*Commissioner of Patents and Trademarks*